US007559808B2

(12) United States Patent
Nishide

(10) Patent No.: US 7,559,808 B2
(45) Date of Patent: Jul. 14, 2009

(54) CONNECTOR

(75) Inventor: Satoru Nishide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/940,459

(22) Filed: Nov. 15, 2007

(65) Prior Publication Data

US 2008/0119091 A1 May 22, 2008

(30) Foreign Application Priority Data

Nov. 20, 2006 (JP) ..... 2006-312726

(51) Int. Cl.
*H01R 13/40* (2006.01)

(52) U.S. Cl. ..... 439/733.1; 439/595; 439/752

(58) Field of Classification Search ..... 439/733.1, 439/752, 595, 871
See application file for complete search history.

(56) References Cited

U.S. PATENT DOCUMENTS 5,478,263 A 12/1995 Kato
5,516,308 A * 5/1996 Yamanashi ..... 439/752
5,709,831 A 1/1998 Endo et al.
6,200,172 B1 3/2001 Konoya et al.
6,648,699 B1 * 11/2003 Makino et al. ..... 439/752
6,780,069 B2 * 8/2004 Scherer et al. ..... 439/752
2006/0046581 A1 3/2006 Okamoto et al.

FOREIGN PATENT DOCUMENTS

JP 2003-151672 5/2003

* cited by examiner

*Primary Examiner*—Tho D Ta
*Assistant Examiner*—Travis Chambers
(74) *Attorney, Agent, or Firm*—Gerald E. Hespos; Anthony J. Casella

(57) ABSTRACT

A connector housing (10) is formed with a mount hole (21) for a retainer (60), and the retainer (60) is inserted into the mount hole (21) to lock and retain terminal fittings (40) inserted into cavities (13). Partition walls (28) partitioning the cavities (13) adjacent in width direction in the connector housing (10) are provided with extended walls (28) projecting into the mount hole (21). The retainer (60) is provided with recesses (66) at positions corresponding to the extended walls (28). A creepage distance between the terminal fittings (40) adjacent with the partition wall (27) therebetween is made longer by the extended wall (28), whereby the short circuit of the adjacent terminal fittings (40) can be prevented.

18 Claims, 6 Drawing Sheets

CONNECTOR

BACKGROUND OF THE INVENTION

1. Field of the Invention

The invention relates to a connector.

2. Description of the Related Art

Japanese Unexamined Patent Publication No. 2003-151672 discloses a connector with a housing formed with cavities arranged side by side across a width direction of the housing. The cavities are configured to receive terminal fittings. A mount hole is formed in an outer surface of the housing and communicates with the respective cavities. The connector also includes a retainer that is insertable into the mount hole to lock and retain the properly inserted terminal fittings.

A partition wall is provided between the cavities that are adjacent in the width direction. The partition wall is cut from the bottom towards the top to form a fitting recess at a position corresponding to the mount hole. The mount hole makes openings in inner walls of the cavities, and the bottom end of the partition wall is at the same height position as these openings. The retainer is provided with a projecting wall fittable into the fitting recess.

The connector can be used, for example, in oil in a transmission of an automotive vehicle. In this environment, threadlike iron pieces, such as abraded scrap of gears, might enter the mount hole of the housing. These threadlike iron pieces might electrically connect the two adjacent terminal fittings by crossing under the partition wall.

The projecting wall of the retainer fits into the fitting recess of the partition wall to lengthen a creeping distance. Thus, a thread-like iron piece is not likely to create a short circuit of the terminal fittings. However, the partition wall is weakened by the fitting recess and the strength of the partition wall might be insufficient when the retainer is not mounted. If the partition wall is broken due to insufficient strength, there is no longer a partition between adjacent terminal fittings, and the terminal fittings might be connected by the threadlike iron piece extending straight.

The invention was developed in view of the above situation, and an object thereof is to prevent the short circuit of adjacent terminal fittings with a partition wall therebetween.

SUMMARY OF THE INVENTION

The invention relates to a connector with a housing formed with cavities for receiving terminal fittings. The cavities are arranged substantially side by side in a width direction. The housing is formed with at least one mount hole for receiving a retainer. The retainer has at least one lock that can be inserted into the cavities to lock the terminal fittings in the cavities. At least one partition wall partitions cavities that are adjacent in the width direction. The partition walls include at least one extended wall projecting into the mount hole. The retainer is formed with at least one recess engageable with the respective extended wall while being inserted to a proper depth in the mount hole.

The partition walls that partition adjacent cavities include the extended walls that project into the mount hole. Thus, even if external matter, such as a threadlike iron piece, enters the mount hole, a short circuit of the terminal fittings on opposite sides of the partition wall is prevented by a creepage distance made longer by a cranked shape extending along the extended wall. Further, a necessary strength for the partition walls is ensured even if the extended walls are provided, the breakage of the partition walls can be avoided and a function of preventing the short circuit between the terminal fittings can be guaranteed. Furthermore, the extended walls engage the recesses of the retainer with the retainer inserted to the substantially proper depth in the mount hole. Thus, the mounting posture of the retainer can be stabilized.

The extended walls preferably project into the mount hole and have projecting ends whose heights are closer to heights of the outer opening than to the heights of the inner openings.

The extended walls engage the recesses of the retainer when the retainer is inserted to the proper depth in the mount hole. Thus, the mounting posture of the retainer can be stabilized.

The retainer preferably is positioned in the housing for movement between a first position where the locking sections are retracted from the cavities to permit the insertion and withdrawal of the terminal fittings into and from the cavities and a second position where the retainer is inserted to the proper depth in the mount hole to insert the locking sections into the cavities, thereby causing the locking sections to act on the substantially properly inserted terminal fittings.

The recesses preferably engage partly with the projecting ends of the extended walls at opening ends thereof when the retainer is at the first position.

The recesses preferably are engaged partly with the projecting ends of the extended walls at opening ends thereof when the retainer is at the partial locking position. Thus, the retainer can be held stably in the partly locked state and a movement thereof toward the full locking position can be guided.

Engaging portions preferably project from side walls of the terminal fittings substantially facing the mount hole in the insertion process into the cavities and the terminal fittings are retained by the engagement of the locking sections with the engaging portions.

The engaging portions preferably are distanced from the adjacent partition walls substantially in the widthwise centers of the side walls of the terminal fittings and individually are locked by the locking sections of the retainer. Thus, the extended walls can be provided on the partition walls so as not to interfere with the locking sections.

The extended wall preferably is a plate extending substantially in a mounting direction of the retainer into the mount hole and has a thickness narrower than the partition wall. The extended wall extends over substantially the entire length of the mount hole in forward and backward directions while preferably having substantially the same width.

The locking sections preferably can enter the cavities through the mount hole and further enter constriction spaces adjacent to constricted portions of the terminal fittings. Thus, the locking sections and portions of the terminal fitting are substantially opposed to each other in a detaching direction.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
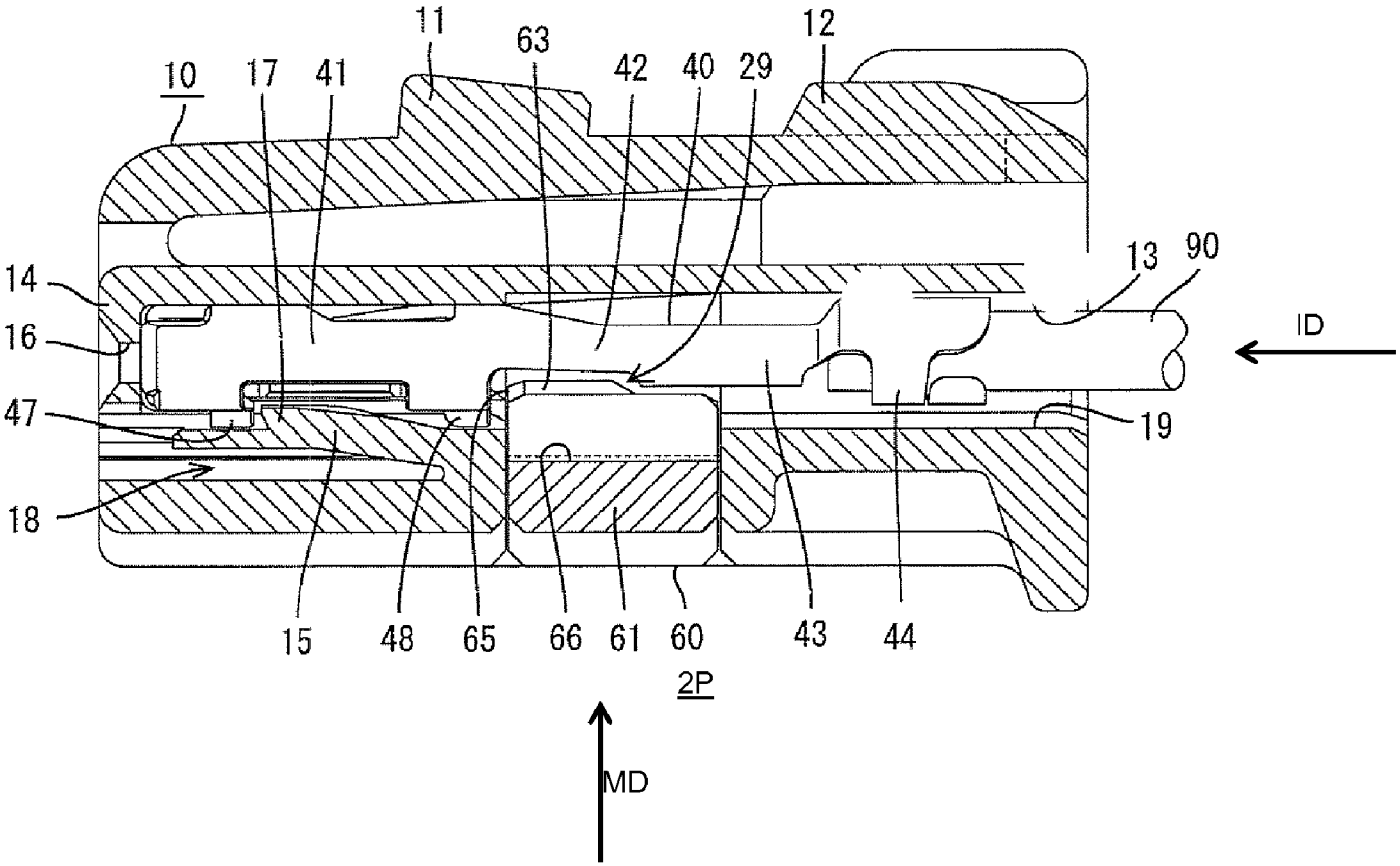
FIG. 1 is a side view in section of a connector according to one embodiment.

A connector in accordance with the invention is illustrated in FIGS. 1 to 6 and has a housing 10, terminal fittings 40 and a retainer 60. The housing 10 is connectable with an unillustrated mating housing. A connecting end with the mating connector is referred to as the front.

The housing 10 is made e.g. of a synthetic resin and is substantially in the form of a flat block. A lock arm 11 is cantilevered backward from the front end of the upper surface of the housing 10. The rear end of the lock arm 11 is resiliently deformable up and down towards and away from the housing 10 with the front end of the lock arm 11 as a support. The lock arm 11 can be engaged with the mating connector housing to hold the two housings together. An operable portion 12 is provided near the rear end of the lock arm 11 and can be pressed to cancel the locked state of the housing 10 with the mating housing.

Cavities 13 are arranged in the width direction WD in the housing 10, and the terminal fittings 40 are inserted into the cavities 13 from behind and along an insertion direction ID. The properly inserted terminal fittings 40 are held in contact with front walls 14 of the cavities 13 and are retained by locks 15 provided on the bottom walls of the cavities 13, as shown in FIG. 1. An insertion hole 16 for a tab of a mating terminal penetrates the front wall 14 of each cavity 14 in forward and backward directions FBD. Each lock 15 is resiliently deformable up and down in a direction intersecting the insertion direction ID. A locking projection 17 is formed on the upper surface of each lock 15 for locking and retaining the terminal fitting 40. A deformation space 18 for the locks 15 is defined in the housing 10 below the locks 15 and in a deflection direction of the locks 15. The deformation space 18 and parts before the locks 15 make openings in the front surface of the housing 10.

Figure 2:
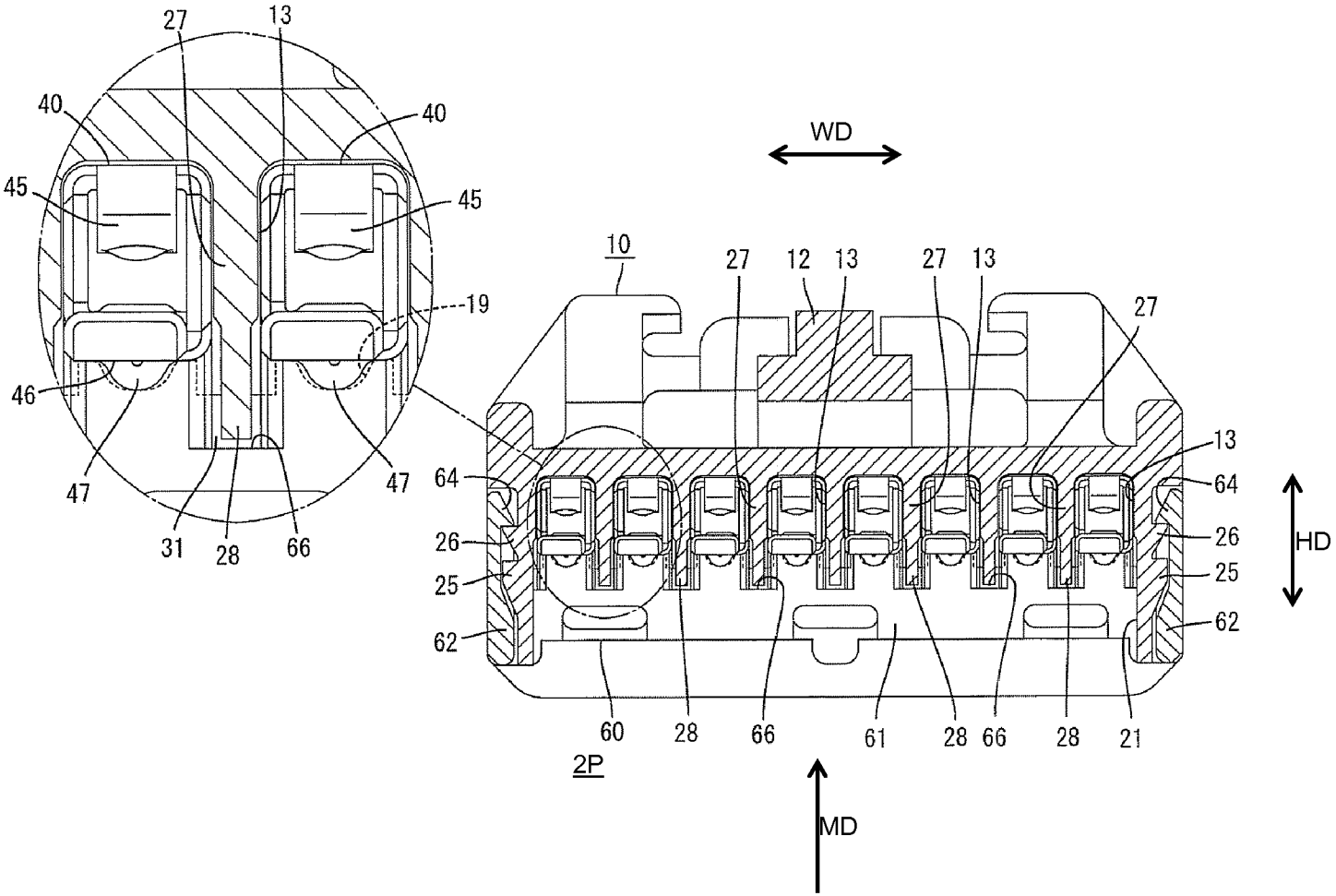
FIG. 2 is a vertical section of the connector when a retainer is located at a full locking position.

Each terminal fitting 40 is a female terminal fitting formed, for example, by bending an electrically conductive metal plate and includes a main portion 41, a constricted portion 42, a wire barrel 43 and an insulation barrel 44 in this order from the front. The wire barrel 43 is crimped, bent or folded connection with a core of a wire 90 and the insertion barrel 44 is crimped bent or folded into connection with an insulated part of the wire 90. The main portion 41 is in the form of a substantially rectangular tube, and the tab of the mating terminal fitting can be inserted through an opening formed in the front surface. A resilient contact piece 45 is provided inside the main portion 41 and is connectable with the tab. Front and rear engaging portions 47, 48 project from a side wall 46 of the main portion 41 and can face towards the inner bottom surface of the cavity 14. The engaging portions 47, 48 are embossed to have mountain-shaped cross sections at a widthwise intermediate part of the side wall 46, as shown in FIG. 2, and are arranged on substantially the same axis extending in forward and backward directions FBD. The front engaging portion 47 is engageable with the locking projection 17 of the lock 15, and the rear engaging portion 48 is engageable with a locking section 63 of the retainer 60.

A receiving groove 19 extends in forward and backward directions FBD in a widthwise intermediate part of the inner bottom surface of each cavity 13 at a position corresponding to the engaging portions 47, 48. Each receiving groove 19 has an arcuate cross section that conforms with the outer surfaces of the engaging portions 47, 48. The engaging portions 47, 48 slide in contact with the receiving groove 19 when the terminal fitting 40 is inserted in a proper posture into the housing 10, and hence permit the insertion of the terminal fitting 40. On the other hand, the engaging portions 47, 48 interfere with the rear opening edge of the cavity 13 if an attempt is made to insert the terminal fitting 40 in an upside-down posture into the housing 10, thereby preventing any further insertion. In other words, the engaging portions 47, 48 prevent the erroneous insertion of the terminal fitting 40 into the cavity 13.

Figure 5:
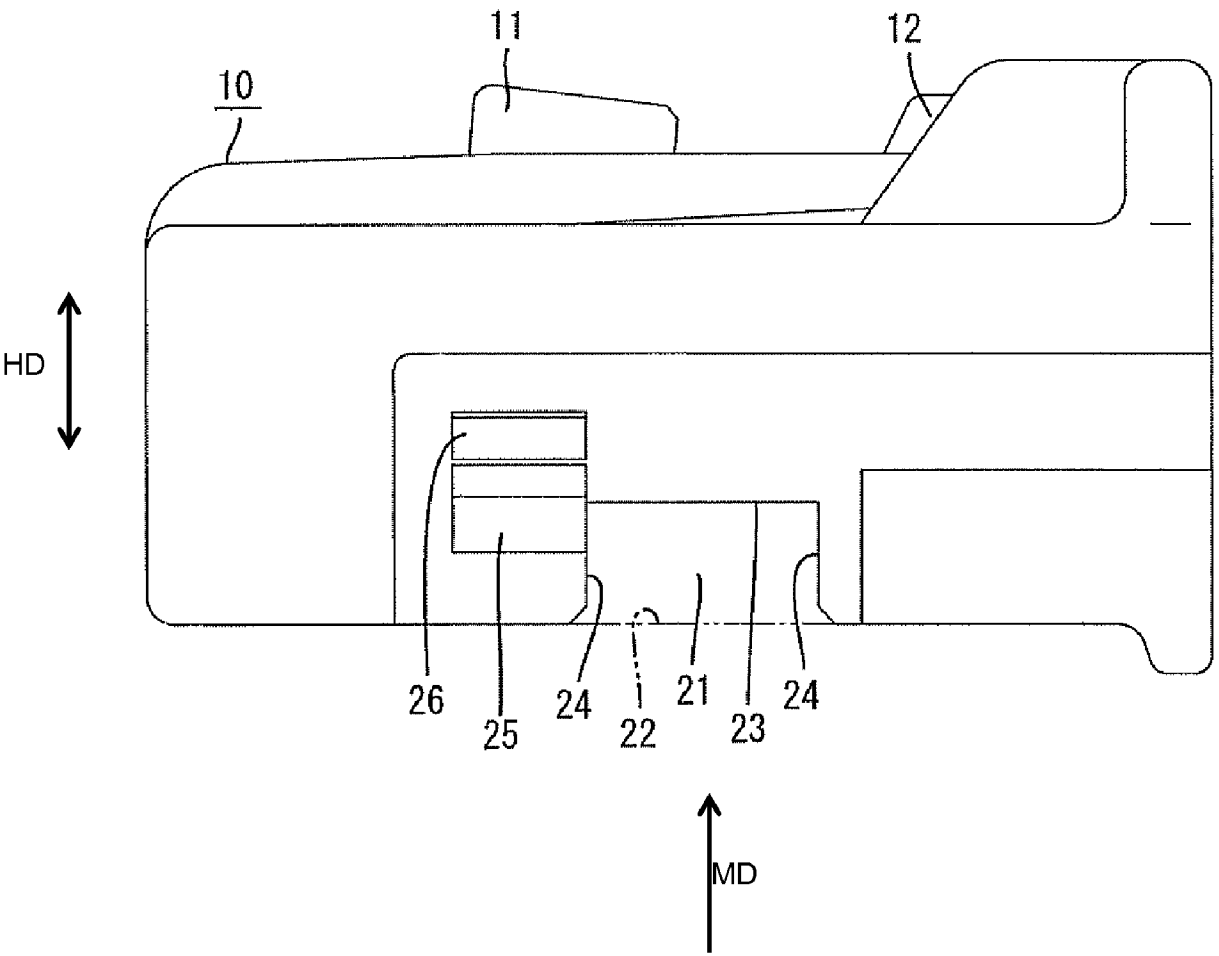
FIG. 5 is a side view of a connector housing.

A mount hole 21 for the retainer 60 is formed in an intermediate part of the outer peripheral surface of the housing 10 with respect to the forward and backward directions FBD of the housing 10. The mount hole 21 communicates with the cavities 13 arranged in the width direction WD and opens in the outer side surfaces of the housing 10. Specifically, the mount hole 21 is formed over three outer side surfaces of the housing 10, i.e. those lateral parts where no lock arm 11 is arranged, specifically the bottom surface opposite to the side where the lock arm 11 is provided, and the left and right surfaces connected with the bottom surface substantially at right angles. More specifically, as shown in FIG. 5, the mount hole 21 has an outer opening 22 formed in the bottom surface of the housing 10, inner openings 23 formed in the inner bottom surfaces of the respective cavities 13 arranged in width direction WD, and side openings 24 formed in the opposite side surfaces of the housing 10, and the formation area thereof preferably is defined by a range from the outer opening 22 to the inner openings 23 with respect to height direction HD and/or defined between the left and right side openings 24 with respect to width direction WD. Partial locks 25 and full locks 26 are provided on the left and right surfaces of the housing 10 and are engageable with locking claws 64 of the retainer 60. The partial locks 25 and the full locks 26 are in the form of ribs extending in forward and backward directions FBD, and a pair of the partial and full locks 25, 26 are arranged one above the other along the lateral opening 24 at a front part of each of the substantially opposite side surfaces of the housing 10.

The cavities 13 that are adjacent in the width direction WD of the housing 10 are partitioned by partition walls 27, and the terminal fittings 40 are separated and insulated from each other by the partition walls 27. An extended wall 28 projects unitarily from each partition wall 27 towards the outer opening 22 in the mount hole 21. The extended wall 28 is a plate that extends in the height direction HD while having a thickness narrower than the partition wall 27. Additionally, the extended wall 28 extends over substantially the entire length of the mount hole 21 in forward and backward directions FBD and has substantially the same width. Furthermore, the projecting end of the partition wall 27 is at a height closer to the height of the outer opening 22 of the mount hole 21 than to that of the inner opening 23 and preferably even lower than the lowest end of the inner bottom surface of the cavity 13. A creepage distance between the adjacent terminal fittings 40 becomes longer due to a cranked or offset path caused by the extended wall 28.

Figure 6:
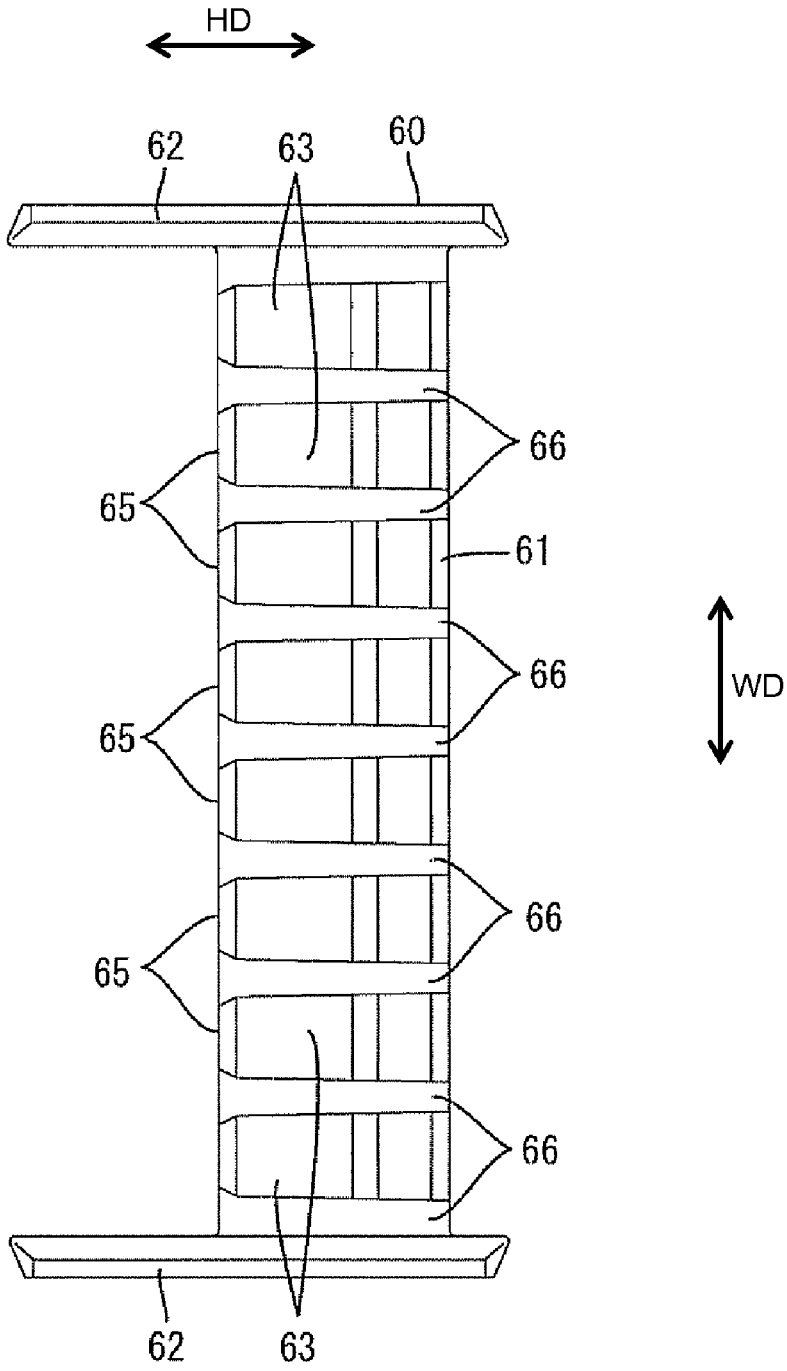
FIG. 6 is a horizontal section of the retainer.

The retainer 60 also is made e.g. of a synthetic resin and includes a retainer main body 61 that extends substantially in the width direction WD. Left and right holding plates 62 are connected with the opposite sides of the retainer main body 61 and extend substantially in the height direction HD, as shown in FIGS. 2 and 6. The retainer main body 61 has a plurality of locking sections 63 substantially in correspondence with the rear engaging portions 48 of the respective terminal fittings 40 arranged side by side in the width direction WD. The holding claws 64 project in from the upper ends of the holding plates 62.

The retainer 60 is movable between a partial locking position 1P where the locking sections 63 are retracted from the cavities 13 to permit the insertion and withdrawal of the terminal fittings 40 into and from the cavities 13 and a full locking position 2P where the locking sections 63 are at least partly located in the cavities 13 to lock the terminal fittings 40 that have been inserted properly into the cavities 13. The retainer 60 can be inserted lightly in the mount hole 21 and held at the partial locking position 1P by engagement of the holding claws 64 with the partial locks 25. On the other hand, the retainer 60 the retainer 60 can be held deeper in the mount hole 21 at the full locking position 2P by the engagement of the holding claws 64 with the full locks 26. The retainer 60 is moved along the mounting direction MD between the partial locking position 1P and the full locking position 2P in directions substantially normal to the inserting direction ID of the terminal fittings 40.

Front portions of the locking sections 63 of the retainer main body 61 are higher than rear portions thereof, and locking surfaces 65 are defined at the front ends of the locking sections 63. The locking surfaces 65 are aligned to face the rear end jaw surfaces and the rear engaging portions 48 of the box-shaped main portions 41 of the terminal fittings 40 when the retainer 60 is at the full locking position 2P. Recesses 66 are formed at the upper end of the retainer main body 61 at substantially opposite sides of the respective locking sections 63. Each recess 66 is disposed and configured to receive and engage the extended wall 28 while defining a narrow clearance 31 that preferably does not exceed 0.20 mm and most preferably does not exceed about 0.17 mm. Each recess 66 is widened in its plan view from the rear end to the front end with respect to the inserting direction ID of the terminal fitting 40.

Figure 3:
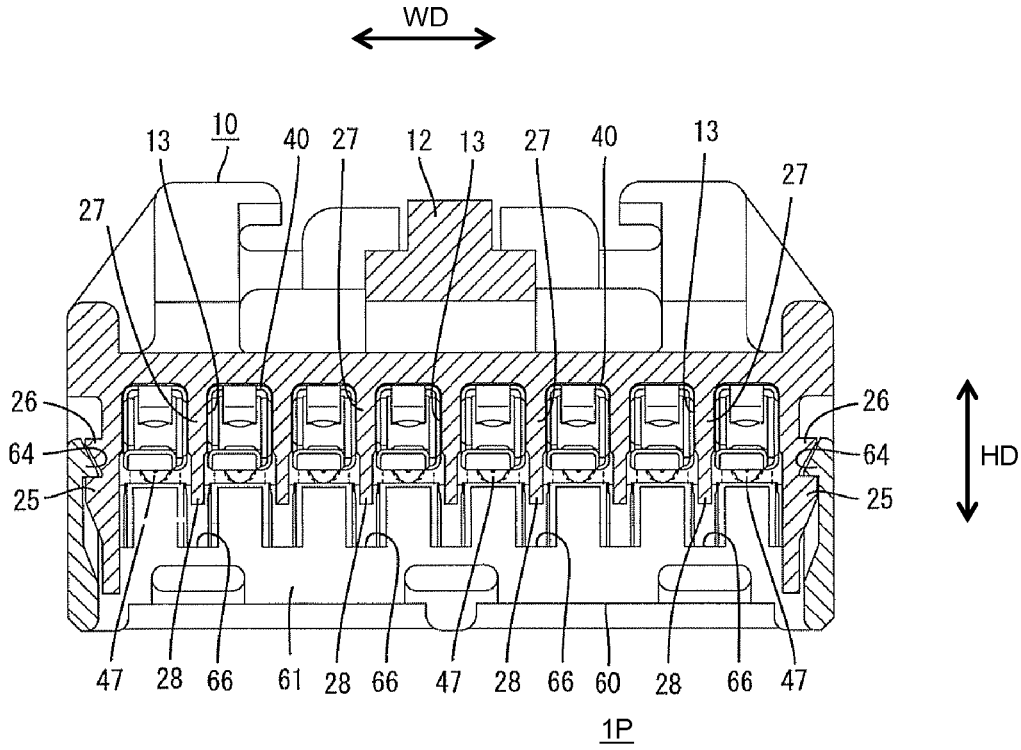
FIG. 3 is a vertical section of the connector when the retainer is located at a partial locking position.
Figure 4:
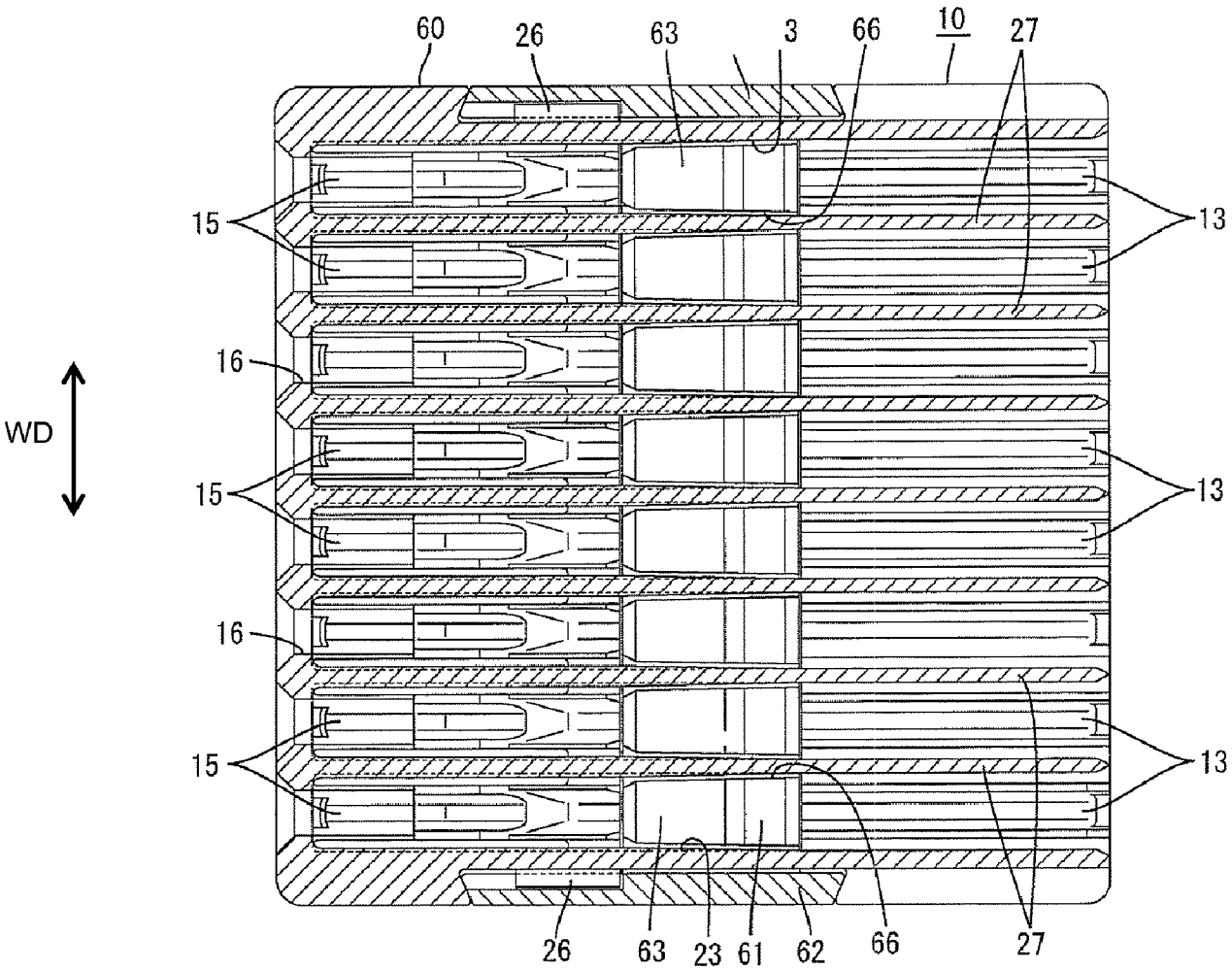
FIG. 4 is a plan view of the retainer.

The retainer main body 61 is inserted along the mounting direction MD, through the outer opening 22 and into the mount hole 21. The holding plates 62 deform resiliently so that the holding claws 64 can engage the partial locks 25 to hold the retainer 60 at the partial locking position 1P, as shown in FIG. 3. At this time, the projecting bottom ends of the extended walls 28 and the open upper ends of the recesses 66 of the retainer main body 61 overlap each other in the height direction HD and at least partly engaged. The locking sections 63 face the inner opening 23 in the mount hole 21 without entering the cavities 13.

The terminal fittings 40 then are inserted into the cavities 13 from behind and along the inserting direction ID. Thus, the engaging portions 47, 48 of the terminal fittings 40 slide in contact with the receiving groove 19 and pass above the locking section 63. The front end of the properly inserted terminal fitting 40 contacts the front wall 14 to prevent any further forward movement of the terminal fitting 40, and the front engaging portion 47 of the terminal fitting 40 is engaged by the locking projection 17 of the lock 15 to prevent a backward movement of the terminal fitting 40. As a result, the terminal fitting 40 achieves primarily locking and has its movements prevented.

The retainer 60 then is pushed in the mounting direction MD towards the full locking position 2P. The holding plates 62 deform resiliently so that the holding claws 64 can engage the full locks 26 to hold the retainer 60 at the full locking position 2P. The extended walls 28 gradually enter the recesses 66 as the retainer 60 is moved from the partial locking position 1P to the full locking position 2P to guide the inserting operation of the retainer 60. The locking sections 63 move through the inner openings 23 of the mount hole 21 and enter the cavities 13 when the retainer 60 reaches the full locking position 2P. The locking sections 63 further enter constriction spaces 29 right below the constricted portions 42 of the terminal fittings 40, as shown in FIGS. 1 and 2. As a result, the locking sections 63 and the rear engaging portions 48 oppose each other in a detaching direction opposite to the inserting direction ID of the respective terminal fittings 40 to achieve secondary locking of the terminal fittings 40. In this state, the extended walls 28 and the recesses 66 are engaged with each other for stably keeping the mounting posture of the retainer 60. Specifically, the projecting ends of the extended walls 28 are located near the bottom surfaces of the recesses 66 and the cranked narrow spaces 31 are defined between the extended walls 28 and the recesses 66 when the retainer 60 is at the full locking position 2P.

External matter, such as a threadlike iron piece, can enter the mount hole 21. This external matter might be sandwiched between the extended wall 28 and the recess 66. However, the extended wall 28 that extends from the partition wall 28 makes the creepage distance between the adjacent cavities 13 sufficiently long to avoid a significant likelihood of connecting the terminal fittings 40 accommodated in the adjacent cavities 13 unless the external matter is very long. As a result, the partition wall 27 prevents a short circuit of terminal fittings 40 in adjacent cavities 13. Further, the recesses 66 are not formed in the partition walls 27. As a result, the partition walls 27 are sufficiently strong to avoid breakage when the retainer 60 is not mounted. Accordingly, a function of preventing the short circuit between the terminal fittings 40 is more reliable. Furthermore, the extended walls 28 engage with the recesses 66 of the retainer 60 with the retainer 60 inserted to a proper depth in the mount hole 21. Thus, the mounting posture of the retainer 60 can be stabilized.

The opening ends of the recesses 66 of the retainer 60 engage the projecting ends of the extended walls 28 when the retainer 60 is at the partial locking position 1P. Thus, the retainer 60 can be held stably held in the partly locked state and movement towards the full locking position 2P can be guided.

The rear engaging portions 48 are distanced from the adjacent partition walls 27 in the widthwise intermediate positions of the side walls 46 of the terminal fittings 40 and individually locked by the locking sections 63 of the retainer 60. Thus, the extended walls 28 can be provided on the partition walls 27 so as not to interfere with the locking sections 63, thereby increasing a degree of freedom in designing.

The invention is not limited to the above described and illustrated embodiment. For example, the following embodiments are also embraced by the technical scope of the present invention as defined by the claims.

The extended walls and the recesses of the retainer may be closely engaged with each other when the retainer is located at the full locking position.

The retainer may be integrally or unitarily connected to the connector housing e.g. via at least one hinge or other connecting means such as one or more pivots, strips or the like.

The retainer may directly reach the full locking position to lock the terminal fittings upon being inserted into the mount hole without having the partial locking position.

The engaging portions may be eliminated from the terminal fittings and the locking sections of the retainer may be engaged only with the rear end jaw surfaces of the box portions of the terminal fittings when the retainer is located at the full locking position.

The invention is also applicable in the case where a retainer is mounted into a housing accommodating male terminal fittings.

The invention is also applicable in the case where the terminal fittings are locked only by a retainer without being locked by respective locks provided in the respective cavities.

What is claimed is:

1. A connector, comprising:

a housing formed with opposite front and rear ends and opposite first and second outer surfaces extending between the ends, a plurality of substantially adjacent cavities arranged substantially side by side in a width direction between the first and second outer surfaces, each cavity having opposite first and second inner surfaces aligned substantially in the width direction, partition walls formed between the adjacent cavities and extending from the first inner surface to the second inner surface of the respective cavities for partitioning the adjacent cavities, at least one mount hole formed in the housing and extending from the first outer surface to the first inner surface for communicating with the cavities, extended walls extending from the respective partition walls and projecting into the mount hole farther than all positions on the first inner surfaces of the cavities adjacent to the mount hole; and at least one retainer mountable into the mount hole of the housing, locking sections provided on the retainer and disposed for projecting into the respective cavities, the retainer being formed with recesses engageable respectively with the extended walls when the retainer is inserted to a proper depth in the mount hole.

2. The connector of claim 1, wherein the mount hole has an outer opening in the first outer surface of the housing and inner openings in the first inner surfaces of the respective cavities, the retainer being inserted into the mount hole from the outer opening towards the inner openings to insert the locking sections thereon into the cavities through the inner openings.

3. The connector of claim 2, wherein projecting ends of the extended walls are closer to the outer opening than to the inner openings.

4. The connector of claim 1, wherein the retainer is movably positioned in the housing between a first position where the locking sections are substantially retracted from the cavities and a second position where the locking sections are in the cavities.

5. The connector of claim 4, wherein opening ends of the recesses are engaged partly with the projecting ends of the extended walls when the retainer is at the first position.

6. The connector of claim 1, wherein each of the extended walls is a plate extending substantially in a mounting direction of the retainer into the mount hole and has a thickness narrower than the partition wall.

7. The connector of claim 6, wherein the extended wall extends over substantially the entire length of the mount hole in forward and backward directions with a substantially uniform width.

8. A connector, comprising:

a housing with opposite front and rear ends and opposite first and second outer surfaces extending between the ends, a plurality of substantially adjacent cavities arranged substantially side by side in a width direction between the first and second outer surfaces, each cavity having opposite first and second inner surfaces aligned substantially in the width directions, partition walls formed between the adjacent cavities and extending from the first inner surface to the second inner surface of the respective cavities for partitioning the adjacent cavities, at least one mount hole formed in the housing and extending from the first outer surface to the first inner surfaces for communicating with the cavities, extended walls extending from the respective partition walls and projecting into the mount hole farther than all positions on the first inner surfaces of the cavities adjacent to the mount hole;

terminal fittings disposed respectively in the cavities; and at least one retainer mountable into the mount hole of the housing, locking sections provided on the retainer and disposed for projecting into the respective cavities for locking the terminal fittings in the cavities, the retainer being formed with recesses engageable respectively with the extended walls when the retainer is inserted to a proper depth in the mount hole.

9. The connector of claim 8, wherein projecting ends of the extended walls are closer to the outer opening than to the inner openings.

10. The connector of claim 8, wherein the mount hole has an outer opening in the first outer surface of the housing and inner openings in the first inner surfaces of the respective cavities, the retainer being inserted into the mount hole from the outer opening towards the inner openings to insert the locking sections thereon into the cavities through the inner openings, whereby the locking sections lock and retain the terminal fittings inserted in the cavities.

11. The connector of claim 10, wherein the locking sections are configured to enter the cavities through the mount hole and further enter constriction spaces adjacent to constricted portions of the terminal fittings, whereby the locking sections and portions of the terminal fitting are substantially opposed to each other in a detaching direction.

12. The connector of claim 8, wherein the retainer is movably positioned in the housing between a first position where the locking sections are substantially retracted from the cavities to permit the insertion and withdrawal of the terminal fittings into and from the cavities and a second position where the locking sections are in the cavities, thereby causing the locking sections to act on the terminal fittings that have been inserted properly into the cavities.

13. The connector of claim 12, wherein opening ends of the recesses are engaged partly with the projecting ends of the extended walls when the retainer is at the first position.

14. The connector of claim 8, wherein engaging portions project from side walls of the terminal fittings substantially facing the mount hole and the terminal fittings are retained by the engagement of the locking sections with the engaging portions.

15. The connector of claim 14, wherein the engaging portions are distanced from the adjacent partition walls and are substantially in widthwise centers of the side walls.

16. The connector of claim 8, wherein each of the extended walls is a plate extending substantially in a mounting direction of the retainer into the mount hole and has a thickness narrower than the partition wall.

17. The connector of claim 16, wherein the extended wall extends over substantially the entire length of the mount hole in forward and backward directions with a substantially uniform width.

18. A connector, comprising:

a housing formed with opposite front and rear ends and opposite first and second outer surfaces extending between the ends, a plurality of substantially adjacent cavities arranged substantially side by side in a width direction between the first and second outer surfaces, each cavity having opposite first and second inner surfaces aligned substantially in the width direction, partition walls formed between the adjacent cavities and extending from the first inner surface to the second inner surface of the respective cavities for partitioning the adjacent cavities, at least one mount hole formed in the housing and extending from the first outer surface to the first inner surface for communicating with the cavities, extended walls extending from the respective partition walls and projecting into the mount hole to positions closer to the first outer surface of the housing than to all positions on the first inner surfaces of the cavities adjacent to the mount hole, each extended wall extending over substantially an entire length of the mount hole in forward and backward directions and having substantially uniform widths that are narrower than the respective partition wall; and at least one retainer mountable into the mount hole of the housing, locking sections provided on the retainer and disposed for projecting into the respective cavities, the retainer being formed with recesses engageable respectively with the extended walls when the retainer is inserted to a proper depth in the mount hole.

* * * * *